United States Patent [19]

Mentschel

[11] 3,958,631

[45] May 25, 1976

[54] HEAT EXCHANGER FOR CATALYTIC GAS CONVERTERS

[75] Inventor: Hellmuth Mentschel, Erlangen, Germany

[73] Assignee: Siemens Aktiengesellschaft, Munich, Germany

[22] Filed: Dec. 10, 1973

[21] Appl. No.: 423,120

[30] Foreign Application Priority Data

Dec. 11, 1972 Germany ..... 2260544
Dec. 11, 1972 Germany ..... 2260514

[52] U.S. Cl. ..... 165/166; 29/157.3 R
[51] Int. Cl.[2] ..... F28F 3/00
[58] Field of Search ..... 165/166; 29/157.3 R

[56] References Cited

UNITED STATES PATENTS

| | | | |
|---|---|---|---|
| 2,952,445 | 9/1960 | Ladd | 165/166 |
| 3,495,656 | 2/1970 | Dickson | 165/166 |
| 3,517,731 | 6/1970 | Rothman | 165/166 |

*Primary Examiner*—Albert W. Davis, Jr.
*Assistant Examiner*—James D. Liles
*Attorney, Agent, or Firm*—Kenyon & Kenyon Reilly Carr & Chapin

[57] ABSTRACT

An improved heat exchanger for a catalytic gas converter, the heat exchanger being of the cross-flow type and comprised of several flow chambers separated from each other by heat exchanger surfaces having small wall thickness in which each flow chamber is sealed at each end with two plane parallel, warp-free sealing surfaces which face each other.

7 Claims, 9 Drawing Figures

HEAT EXCHANGER FOR CATALYTIC GAS CONVERTERS

BACKGROUND OF THE INVENTION

This invention relates to heat exchangers for catalytic gas converters, also referred to as reformed-gas generators, in general and more particularly to an improved heat exchanger for such use.

Catalytic gas converters are used for example, in the operation of internal-combustion engines. In such devices, a mixture of fuel and primary air or exhaust gas is catalytically converted into a fuel gas, also referred to as a reformed gas, which is then fed along with secondary air to the internal combustion engine where it is burned. The principle and operation of such devices are disclosed in detail in U.S. patent application Ser. Nos. 218,696 and 270,923 filed respectively on Jan. 18, 1972 and July 12, 1972, both of which are assigned to the same assignee as the present invention.

For proper operation of an internal-combustion engine using a gas converter of this nature, a heat exchanger to cool the fuel gas which is generated in the catalytic gas converter is required. Otherwise, self-ignition of the fuel gas when the secondary air was added thereto, can result with knocking in the internal-combustion engine. Cooling of the reformed gas avoids knocking and at the same time increases the output of the engine by increasing the volumetric efficiency of the cylinders. Furthermore, by using such a heat exchanger, the heat removed from the fuel gas can be utilized for evaporating the fuel supplied to the catalytic gas converter. Also, heat exchangers of the nature disclosed herein, can be used for the heating of the primary air which is fed to the gas converter through the use of the waste heat of the fuel gas or the exhaust gases of the engine.

The heat exchangers used in such catalytic gas converters, which operate at extremely high temperatures, must be gas tight though the gases are aggressive and must be capable of withstanding the high temperature and in addition, must be free of stress so as to be able to withstand frequent temperature changes of large magnitude. In addition, such a heat exchanger must have adequate stability.

SUMMARY OF THE INVENTION

The present invention provides a heat exchanger which meets the above noted requirement and which can be produced in a simple and inexpensive manner.

The primary manner in which this is accomplished is by making a heat exchanger of a cross-flow nature which comprises several flow chambers separated from each other by heat exchange surfaces having a small wall thickness, with each flow chamber sealed on each end and provided with two plane parallel, warp-free sealing surfaces which face each other.

The two heat exchanger surfaces which make up the walls of the chamber are separated at each end by a spacing member which has a section which has a material thickness essentially equal to the wall thickness of the heat exchanger surfaces. This section is the section which abuts the wall and which is welded thereto to form the parallel sealing surfaces, i.e., a section of this thickness is formed on each side of the spacer for attachment to a heat exchanger surface on each side so as to form two plane parallel sealing surfaces between the spacers and the heat exchanger surfaces. To achieve the advantages of the present invention to the highest degree, it is adviseable that the spacing member and the heat exchanger surfaces which are bonded together to form the sealing surfaces are of the same alloy steel.

The heat exchanger of the present invention is constructed by welding the spacers to the heat exchanger surfaces to form a plurality of chambers. As noted above, to obtain ideal gas tight welded seams, the heat exchange surfaces and the spacers will be of the same material and at the point of sealing, will have material thicknesses which are approximately equal. Under these conditions, the welds can be made without distortion of the chambers or a tendency of the welded seams to stress crack. The chambers are then stable units for the cross-flow heat exchanger.

The chambers so formed are then welded together again with spacers in the same manner, to form chambers in a direction perpendicular to the initially formed chambers. The final assembly is then arranged in a frame of square steel bar stock which is used for stiffening. All joints are continuously welded seams, joining together only like material of approximately equal wall thickness and thus, fulfill the most favorable conditions for gas tightness.

In a further embodiment, means are shown for increasing the total heat exchange area of the heat exchanger for the same total volume without appreciably reducing the cross section for gas flow and thus, not increasing the pressure loss appreciably. In this embodiment, a plurality of half-round sections whose longitudinal axes extends in the flow direction of the gas are welded to the heat exchange surface. Preferably, these are arranged so that their convex sides point toward the heat exchange surfaces. These sections may be either spot- or seam-welded.

DETAILED DESCRIPTION OF THE PREFERRED EMBODIMENT

Figure 1:
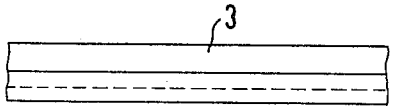
FIG. 1 is an elevation view of a first type of spacer member according to the present invention.
Figure 2:
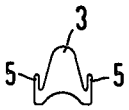
FIG. 2 is an end view of the spacer of FIG. 1.

FIG. 1 illustrates an elevation view and FIG. 2 an end view of a first type of spacer which may be used in the heat exchanger of the present invention.

The spacer itself is designated by the reference numeral 3 and as illustrated, has sections on each side, designated 5, which terminate with a thickness which is approximately equal to the thickness of the heat exchanger surfaces which are to be welded thereto. Spacers of this nature, can be either milled from square stock or hot-rolled or cold-drawn to obtain a cross section as illustrated on FIG. 2. Construction using hot-rolling or cold-drawing will result in material savings over those which are milled.

Figure 3:
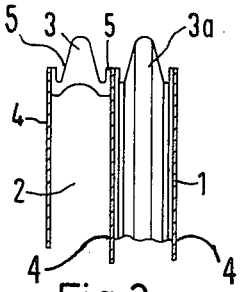
FIG. 3 is a plan view of one end of a section of a heat exchanger constructed according to the present invention.

FIG. 3 illustrates the spacer 3 welded to two heat exchanger surfaces 4. As illustrated, the heat exchanger surfaces 4 are welded to the sides 5 of the spacer 3. As noted above, because the portion 5 and the heat exchanger surface 4 are of essentially equal thickness, an extremely stress free and gas tight weld will result. A similar spacer 3 will be welded on the bottom to form a chamber 2. A plurality of these chambers can be formed after which the chambers will then be welded together using additional spacers 3*a* as illustrated to result in a plurality of flow chambers 1, which are perpendicular to the flow chambers 2 originally formed. The spacer 3*a* shown on FIG. 3 is seen in a plan view and when attached to the heat exchanger surfaces 4 will form a chamber therebelow. The end of the spacer 3*a* will have a compound shape as shown. That is, it will be curved both in a direction out of the paper and in an upward direction as illustrated. The reason for this will more evident when referring to FIG. 6.

Figure 4:
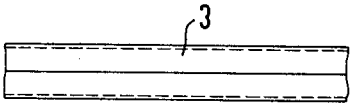
FIG. 4 is an elevation view of a second type of spacer.
Figure 5:
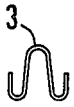
FIG. 5 is an end view of the spacer of FIG. 4.

FIGS. 4 and 5 illustrate a second type of spacer. This type of spacer may be easily stamped out of the proper alloy steel in the shape shown to provide essentially the same advantages associated with the spacer 3 shown in FIGS. 1 and 2.

Figure 6:
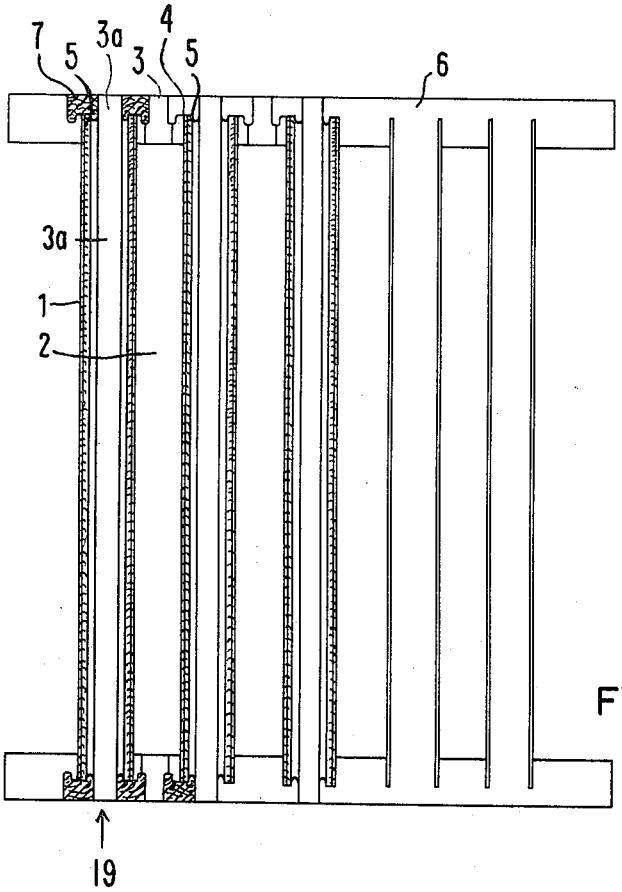
FIG. 6 is a plan view partially in sections of a plurality of the chambers of FIG. 3, arranged in a frame.

FIG. 6 illustrates a plurality of the chambers of FIG. 3 arranged in a frame 6. As noted above, this will be a stiffening frame and will be typically made of bar stock. In the embodiment of FIG. 6, the spaces between the projecting portions of the spacers of FIGS. 1 through 5, are filled with welding compound. Thus, as shown, the projecting end portions will be inserted between respective frame members 7 and are welded thereto, and to the frame 6. As in FIG. 3, the reference numeral 3*a* designates a spacer seen in plan view and the reference numeral 3, a spacer seen in end view. As in FIG. 3, chambers 2 which permit flow into the paper and chambers 1 which permit flow perpendicular thereto i.e., in the direction of arrow 19, are formed.

Figure 7:
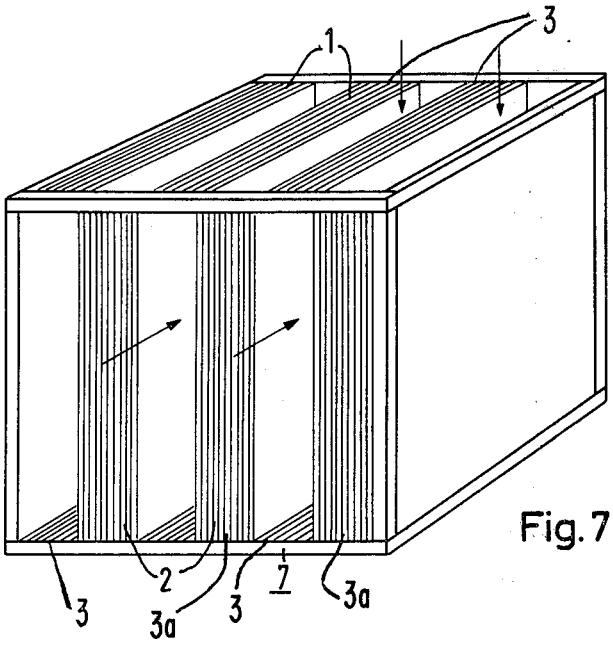
FIG. 7 is a perspective view illustrating somewhat schematically a heat exchanger such as that of FIG. 6.

A perspective view somewhat in a schematic form of the arrangement of FIG. 6 is shown on FIG. 7. This figure clearly illustrates the cross flow which may be obtained with the fuel gas, for example, being directed through the chambers 1 and a cooling medium through the chambers 2, each in the direction shown by the arrows.

Figure 8:
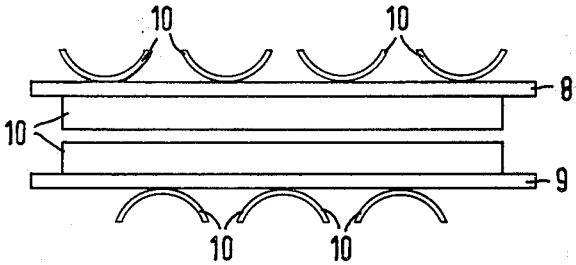
FIG. 8 is a plan view of a portion of two heat exchanger walls illustrating the attachment of half-round sections to increase the area of the heat exchanger.
Figure 9:
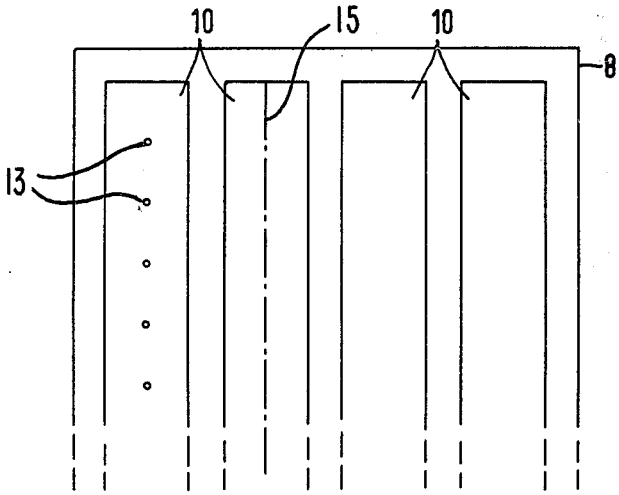
FIG. 9 is a plan view of the arrangement of FIG. 8 illustrating the types of welds which may be used.

FIGS. 8 and 9 illustrate the manner in which the heat transfer area may be increased. Shown are two heat exchanger surfaces designated 8 and 9, corresponding to the heat exchanger surfaces 4 in the previous figures. Welded to the heat exchanger surfaces 8 and 9 with their longitudinal axes extending in the direction of flow are a plurality of half-round sections 10. Preferably, as shown, these are attached with their convex sides against the heat exchanger surfaces. FIG. 9 illustrates that the half-round sections 10 may be attached by spot-welding as indicated by the dots 13 or by a continuous seam weld as indicated by the dot-dash line 15. These half-round sections typically may be fabricated from 0.3 mm thick steel tubes by cutting lengthwise, or may be made by punching them from suitable steel stock. The heat exchanger surfaces themselves may typically be 0.5 mm thick with the sections 5 which are welded thereto to form the two plane parallel welded seam of substantially the same thickness.

The heat exchanger of the present invention is very well suited for use in catalytic gas converters, since it has gas tight and largely stress-free welded seams and ensures sufficient stability for at least two opposite, plane parallel sealing surfaces. By designing the heat exchanger with an adjustable heat flux, the heat exchange area can be enlarged without appreciable reduction of the cross section for gas flow and with no appreciably increase in the pressure loss.

Thus, an improved heat exchanger for use in catalytic gas converters and the like has been shown. Although specific embodiments have been illustrated and described, it would be obvious to those skilled in the art that various modifications may be made without departing from the spirit of the invention which is intended to be limited solely by the appended claims.

What is claimed is:

1. In a crossflow heat exchanger having a plurality of flow chambers separated from each other by heat exchange surfaces with the heat exchange surfaces separated on opposite sides by spacers and having edges attached to said spacers to seal the chambers, the spacers having portions at areas where they abut the heat exchange surfaces which are surface sections parallel to and essentially of the same thickness as the heat exchange surfaces, the improvement comprising:

a. spacers having a profile such as to present parallel surface sections having edges directed toward the outside of the chambers; and b. a gas tight welded seam welding the edges of each parallel surface section to the edge of a heat exchanger surface.

2. A heat exchanger according to claim 1 wherein said heat exchanger surfaces and said spacers are made of the same material.

3. The invention according to claim 2 wherein the heat exchanger surfaces and the spacer consist of alloy steel.

4. The heat exchanger according to claim 1 and further including a plurality of half-round sections welded to the heat exchange surfaces with their longitudinal axis extending in the flow direction through the heat exchanger.

5. The invention according to claim 4 wherein said half-round sections have their convex sides attached to said heat exchange surfaces.

6. The invention according to claim 5 wherein said half-round sections are spot-welded to said heat exchanger surfaces.

7. The invention according to claim 5 wherein said half-round sections are welded to said heat exchanger surfaces in a continuous welded seam.

* * * * *